US005901874A

United States Patent [19]

Deters

[11] Patent Number: 5,901,874

[45] Date of Patent: May 11, 1999

[54] HANDICAPPED ACCESSIBLE DUMPSTER

[75] Inventor: Thomas E. Deters, Columbia, Mo.

[73] Assignee: Breakthrough Marketing, Inc., Columbia, Mo.

[21] Appl. No.: 08/818,153

[22] Filed: Mar. 14, 1997

Related U.S. Application Data

[60] Provisional application No. 60/017,025, May 7, 1996.

[51] Int. Cl.[6] ..... B65D 90/58; B65D 90/60; B65D 25/04

[52] U.S. Cl. ..... 220/694; 49/409; 220/908

[58] Field of Search ..... 220/908, 908.3, 220/501, 694, 345.1–345.6; 232/43.1, 47; 312/290, 296, 294, 304; 414/406–409; 49/409

[56] References Cited

U.S. PATENT DOCUMENTS

| | | | |
|---|---|---|---|
| 569,990 | 10/1896 | Arrick | 232/43.1 |
| 1,220,422 | 3/1917 | Hewitt | 220/501 X |
| 2,929,622 | 3/1960 | Thorson . | |
| 3,017,233 | 1/1962 | Gates | 312/304 |
| 3,339,785 | 9/1967 | Nugent | 220/345.6 X |
| 3,504,813 | 4/1970 | Weir . | |
| 3,550,559 | 12/1970 | Long . | |
| 3,818,636 | 6/1974 | Calais et al. | 49/409 X |
| 3,981,102 | 9/1976 | Harwood et al. | 49/409 X |
| 4,090,265 | 5/1978 | Baus . | |
| 4,176,496 | 12/1979 | Röck et al. . | |
| 4,288,887 | 9/1981 | Johnson et al. | 49/409 X |
| 5,011,036 | 4/1991 | Souza et al. . | |
| 5,015,142 | 5/1991 | Carson | 414/408 |
| 5,080,251 | 1/1992 | Noack | 232/47 X |
| 5,248,057 | 9/1993 | Taylor . | |
| 5,314,221 | 5/1994 | Hammer . | |
| 5,360,132 | 11/1994 | Edelhoff . | |
| 5,423,448 | 6/1995 | Pedigo . | |

FOREIGN PATENT DOCUMENTS

| | | | |
|---|---|---|---|
| 520636 | 3/1931 | Germany | 49/409 |
| 1602378 | 11/1981 | United Kingdom | 220/908 |

*Primary Examiner*—Allan N. Shoap
*Assistant Examiner*—Joe Merek
*Attorney, Agent, or Firm*—Richard C. Lithan

[57] ABSTRACT

A refuse container having features which adapt it to comply with federal laws and regulations facilitating use by handicapped individuals. The dumpster may have any or all of the standard commercially available features of a front-end or rear-end loaded refuse bin for automatic overhead emptying of the trash from the bin into a garbage truck. Access for deposit of trash by non-disabled individuals is provided by at least one top lid hinged to the body of the bin over a deposit opening, preferably in a top wall of the dumpster. For access by disabled individuals, a gliding door covering a second deposit opening in a side wall of the dumpster is provided at a height no greater than 34 inches from the point of contact with the ground. The tracks of the gliding door are specially configured to prevent or minimize the collection of debris and ice which could hamper the ability of a disabled individual of minimal manipulative abilities to open the gliding door. An oversized handle is further provided to facilitate opening of the gliding door. Furthermore, a hinged baffle overhang is provided on the interior of the trash bin to deflect garbage deposited through the top deposit opening and delay the accumulation of a garbage pile inside immediately in front of the gliding door opening.

10 Claims, 8 Drawing Sheets

HANDICAPPED ACCESSIBLE DUMPSTER

CROSS-REFERENCE TO RELATED APPLICATION

This application claims the benefit of U.S. Provisional Patent Application Ser. No. 60/017,025, filed May 7, 1996.

BACKGROUND OF THE INVENTION

1. Field of the Invention

The present invention relates to refuse containers commonly referred to as dumpsters, having access features which facilitate use by handicapped individuals and comply with federal laws and regulations.

2. Description of the Relevant Art

With the passage of the Americans With Disabilities Act (ADA) an increasing social awareness of the difficulties encountered by handicapped individuals has followed. Simple everyday objects, manipulation of which is taken for granted by individuals without disabilities, may cause great difficulty to an individual who is handicapped or somewhat disabled. One such object is the dumpster, which term is used herein to generally describe a usually commercially supplied, outdoor trash or garbage container, usually having a volume of several cubic yards, and usually supplied with front-end or rear-end loading sleeves or pins as appropriate for the collection of trash by an automated garbage truck.

U.S. Pat. No. 3,504,813 issued Apr. 7, 1970 to Weir describes one such commercial refuse container, showing features of the type typically used with a front-end loading garbage truck, and further showing a typical sliding door arrangement. Notably, the doors are placed too high on the bin to accommodate handicapped individuals in wheelchairs. Compliance guidelines as set by federal law and regulations have established maximum reach requirements suited for use by handicapped individuals. Ideally, the lower edge of such a sliding door should be set in the dumpster no higher than 34 inches from the support surface on which the handicapped individual and dumpster reside. This height would ideally accommodate wheel chair bound individuals and would accommodate smaller dumpsters of about 4 cubic yards in volume.

Standard trash bin sliding doors also fail to provide a door tracking mechanism which minimizes the effort needed to open the sliding door. In conventional dumpsters, trash and other particles cannot escape the door's track, thus lodging in the track and thereby sufficiently hampering smooth door movement to overcome the ability of a handicapped person with reduced manipulative abilities to open the door. Moreover, freezing weather conditions may cause the door and track to become iced, also causing disabling circumstances for weakened individuals.

Although U.S. Pat. No. 5,011,036 issued Apr. 30, 1991, to Souza et al. describes a foot operated, front-loading refuse bin which has disadvantages similar to the conventional dumpster, including inaccessible doors and a foot lever which may be impossible to operate by wheelchair-bound individuals, particularly paraplegics. U.S. Pat. No. 5,248,057 issued Sep. 28, 1993, to Taylor describes a double actuated trash bin lid operated by a handled lever disposed to the side of the trash bin. Again, the doors are inaccessible to wheelchair bound individuals; moreover, the lever requires a large amount of rotation to actuate the doors which may result in the handle being rotated beyond the reach height of the wheelchair bound individual.

Other variously configured trash bins are described in U.S. Pat. No. 5,360,132 to Edelhoff, wherein a trash bin door is pivoted along a gentle arc, and U.S. Pat. No. 5,423,448 issued Jun. 13, 1995, to Pedigo, wherein a cylindrical dumpster is described. Neither show features suited for use by handicapped individuals.

None of the relevant art which is intended to facilitate use by a handicapped individual is directed towards a trash bin. For example, U.S. Pat. No. 5,314,221 issued May 24, 1994 to Hammer describes a ball and socket arrangement for aiding handicapped persons having limited reach or mobility to move unreachable objects. The structure is dissimilar to the present invention and is not adaptable to a trash bin.

Moreover, no doors show anti-jamming features directed at minimizing and preventing collection of falling debris or precipitation in the gliding mechanism of the door. U.S. Pat. No. 3,550,559 issued Dec. 29, 1970, to Long shows a dog kennel gate having a sliding construction suspended by roller elements from an inverted channel. A pintle and slot arrangement is provided at the bottom of the gate to prevent rocking. In U.S. Pat. No. 2,929,622 issued Mar. 22, 1960, to Thorson, a similar pintle and slot arrangement is shown, intended again solely to allow sliding movement of the door in only one plane. In both the '559 and '622 patents, the door when closed occludes the slot, and thus blocks passage of material through the slot; moreover, both patents fail to teach any use of a slot in a door assembly, particularly in combination with a dumpster, for the purpose of limiting jamming due to collecting debris. Likewise, U.S. Pat. No. 4,176,496 issued Dec. 4, 1978 to Röck et al. and U.S. Pat. No. 4,090,265 issued May 23, 1978 to Baus show overhead trackinq sliding door assemblies for furniture doors and wet chambers, respectively, each teaching away from allowing free passage of debris and matter through a passage in a lower track.

None of the above inventions and patents, taken either singly or in combination, is seen to describe the instant invention as claimed.

SUMMARY OF THE INVENTION

The present invention relates to refuse containers commonly referred to as dumpsters, having access features which facilitate use by handicapped individuals and comply with federal laws and regulations. The dumpster of the preferred embodiment may include any or all of the standard commercially available features of a front-end or rear-end loaded refuse bin adapted for automatic overhead emptying of the trash from the bin into a garbage truck. The dumpster is generally a parallelepiped bin having a floor and four side walls defining a refuse chamber, the bin capped by a top wall of varying configuration. Access for deposit of trash by non-disabled individuals is provided through a deposit opening, preferably in the top wall, usually covered by at least one lid moveably attached, often hinged, to the body of the bin. A trash exit and associated lid opposes the deposit opening and allows conventional overhead emptying operation by a garbage truck approaching the dumpster from either direction and parallel with the dumping attachment means or sleeves provided, as known in the prior art.

For access by disabled individuals, a second deposit opening in a side wall of the dumpster is provided at a height no greater than 34 inches from the lower edge of the second deposit opening to a point of contact with the ground or other supporting surface. A gliding door includes a frame having overhead rails receiving rollers from which a door panel hangs and covers the second deposit opening. A lower track of the frame is configured to provide a through-channel which restricts the freely gliding door panel from lateral movement while preventing or minimizing the collection of debris and ice which could hamper the ability of a disabled individual of minimal manipulative abilities to move the gliding door. In accordance with ADA guidelines, the gliding door is functionally designed having a threshold for sliding movement of less than five pounds of static pressure. An oversized knob is further provided to facilitate opening of the gliding door by manually disabled individuals.

Furthermore, a baffle overhang is provided on the interior of the trash bin to deflect garbage deposited through the top deposit opening and thereby delay the accumulation of a garbage pile inside and immediately in front of the gliding door and second deposit opening. The baffle overhang is therefore critically positioned relative to both the top deposit opening and the second deposit opening. The baffle overhang is a panel hinged to one side wall having the second deposit opening and proximate the top deposit opening; the panel is downwardly inclined into the refuse chamber away from the second deposit opening. The panel also transversely extends between opposing side walls of the bin adjacent the wall of the second opening, forming an overhang below and across the top deposit opening and over the second deposit opening. Each opposing side wall has a rest stop protruding inwardly into the refuse chamber to support the overhang panel. In a second embodiment, a second vertical baffle is affixed to the floor of the chamber to further divide the chamber and prevent accumulation of garbage in front of the second deposit opening.

Moreover, because the baffle overhang is hinged to the side wall having the second deposit opening, when the dumpster of the preferred embodiment is upended in an automatic, overhead emptying operation by a garbage truck, the overhang falls toward and freely through the top deposit opening, preventing garbage from being caught in what otherwise would form a V-shaped trough under the panel. In a second embodiment, the panel defining the baffle overhang is dimensioned to be larger than the deposit openings so that when the panel is overturned it occludes the deposit openings from inside the chamber thereby preventing unintended loss of trash during the emptying operation by the garbage truck.

Also, the overall functional design of the gliding door and baffle is suitable for retrofitting a standard dumpster. Each of the components of the gliding door are adapted for use with a preexisting dumpster, including fasteners, a tubular frame for reinforcing a modified dumpster wall opening, protective edging of the frame protecting against user contact with potentially sharp edges of the modified dumpster wall, and a streamlined profile to limit protrusion from the dumpster wall.

Accordingly, it is a principal object of the invention to provide a dumpster which is accessible to disabled individuals.

It is another object of the invention to provide a dumpster with a bin side wall opening and gliding door which complies with reach, height and access requirements for handicapped individuals as set forth by federal law and regulations.

It is a further object of the invention to provide a gliding door which minimizes effort needed to open the gliding door to less than five pounds of static pressure.

Still another object of the invention is to provide a dumpster having a baffle overhang above the side wall opening to reduce the accumulation of garbage within the bin immediately in front of the side wall opening, due to garbage deposited through other non-handicapped accessible deposit openings.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention relates to refuse containers commonly referred to as dumpsters, having access features which facilitate use by handicapped individuals and comply with federal laws and regulations. Referring to both FIG. 1 and FIG. 2, the dumpster 10 of the preferred embodiment is adapted from the type of dumpster commercially available and having standard features for front-end or rear-end loading and automatic overhead emptying of the trash from the dumpster into a garbage truck. A dumpster of approximately 4 cubic yards volume is shown, although larger dumpsters may adapted according to the present invention.

Figure 4:
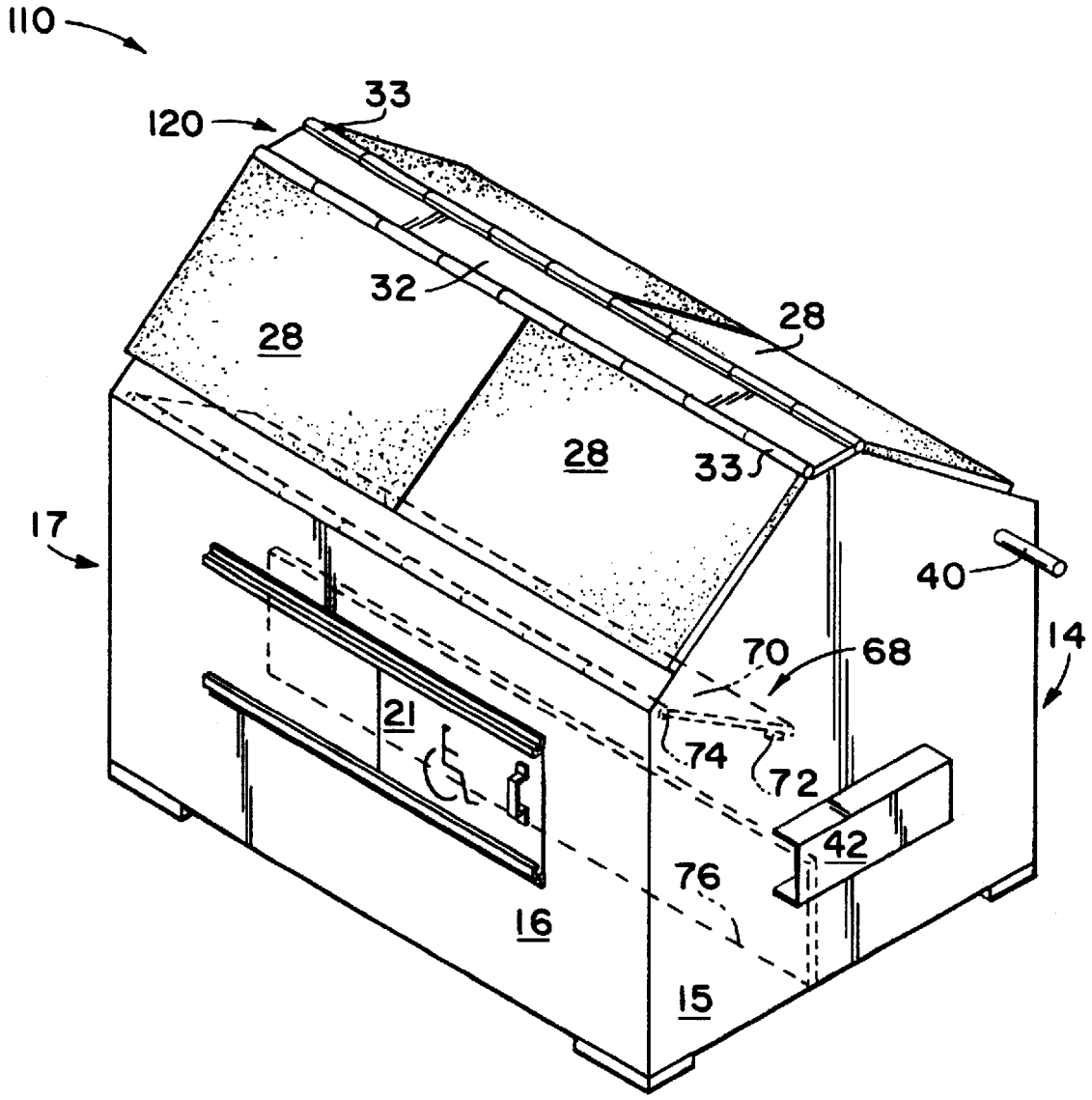
FIG. 4 is a perspective view of a second embodiment of a handicapped accessible dumpster.
Figure 5:
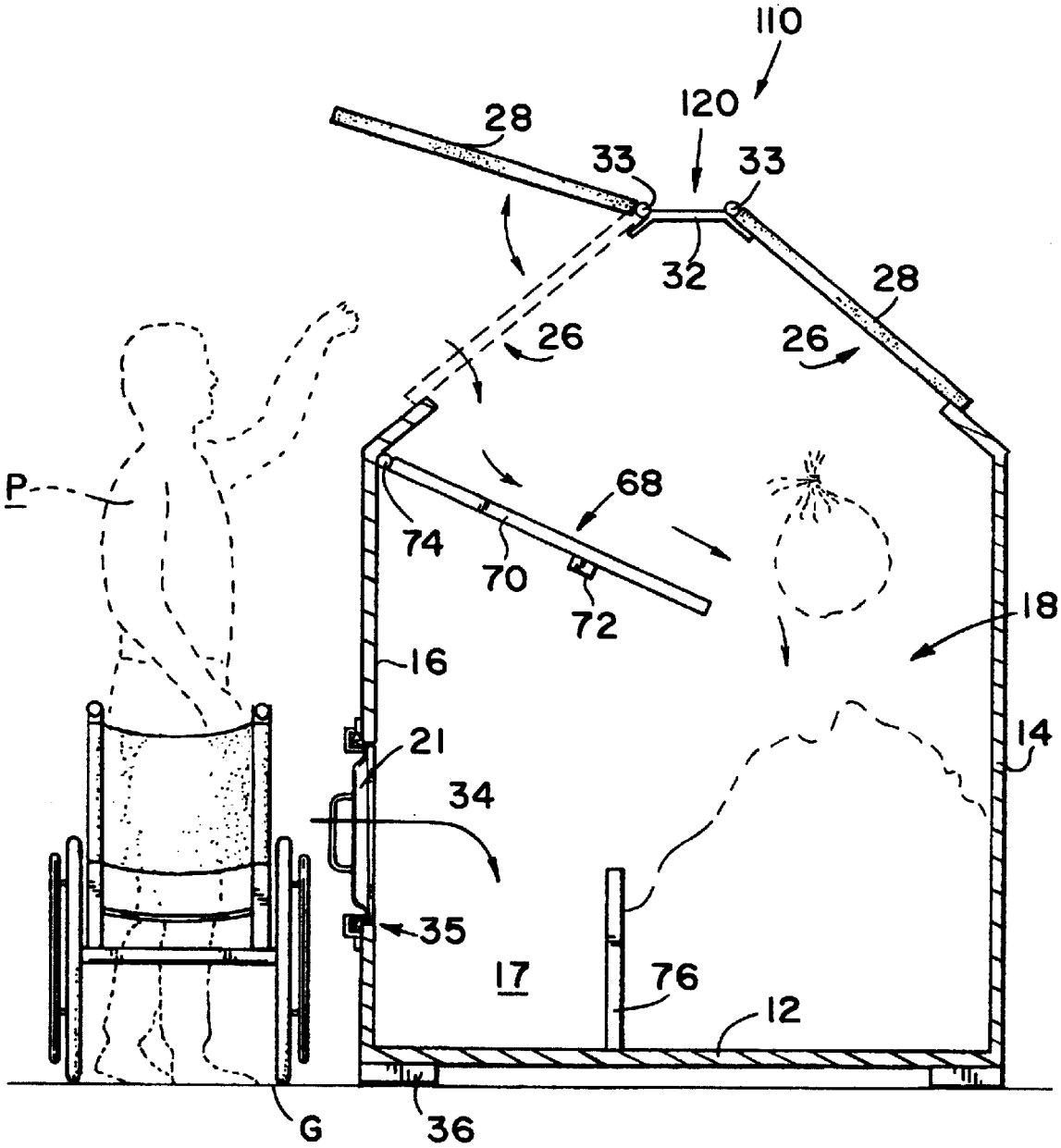
FIG. 5 is an environmental, side elevation sectional view of the handicapped accessible dumpster of FIG. 4.

The dumpster 10 should have the general operating features common to most dumpsters, being preferably a parallelepiped bin, having a floor 12 and four side walls 14,15, 16,17, defining a refuse chamber 18 within. The four side walls may be capped by a top wall 20 of varying configuration in which one or more of a top deposit opening 26 is located for the deposit of trash by a non-disabled or ambulatory individual P (as shown in environmental view FIG. 5), being capable of reaching a top lid 28 hinged to and covering the opening 26. Such openings 26 may also serve as an exit port through which garbage within the chamber 18 is emptied during a refuse collection operation. It should be noted that any configuration of the top wall 20 in which a top deposit opening 26 is provided can be used with the below described handicapped-accessible features; as an alternative example, an inclined top wall 120 is shown in FIGS. 4 and 5 having a cross bar 32 to which a conventional collar and rod assembly 33 attaches a plurality of top lids 28 to provide opposingly opening lids 28,28.

Figure 6:
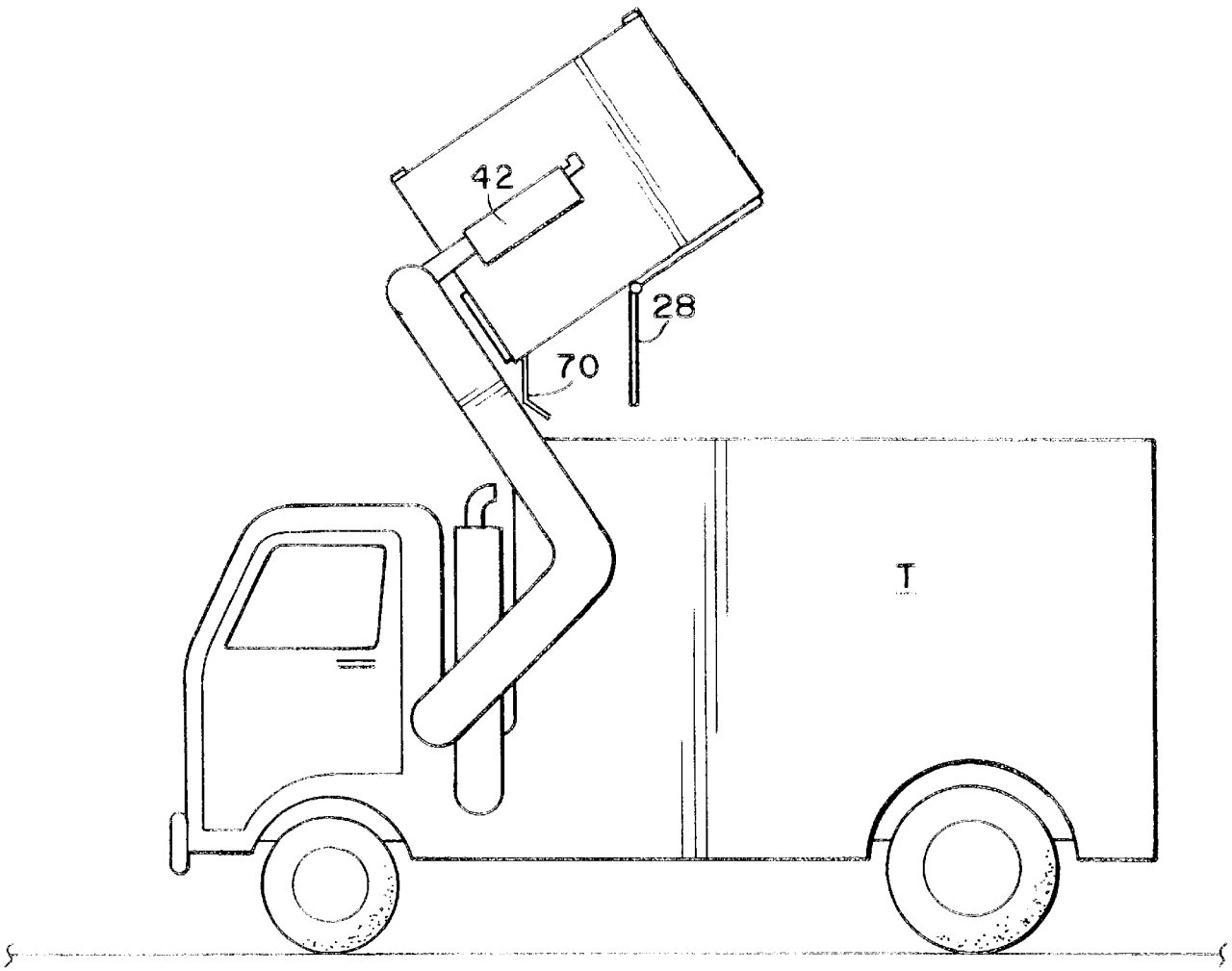
FIG. 6 is an environmental, elevational view of the dumpster according to the present invention shown in a stage during an overhead emptying operation, showing the baffle cleared of a top opening.

As noted, the deposit openings 26 are arranged to permit an overhead emptying operation (as generally suggested by FIG. 6), to be performed by a garbage truck approaching a dumpster from a direction parallel to the side walls and engaging dumping attachment means, typically sleeves 42 or pins 40, as known in the prior art. The deposit or exit openings 26 are generally opposed to one another to provide dual doors hinged to fall open as the bin is overturned. The sleeves 42 allow a front-end fork-lift loader of a garbage truck T to pick up the dumpster 10 and, as it is lifted overhead, cause the top lids 28 to swing open by force of gravity and allow dumping of the garbage into the truck in the conventional manner. Dumping attachment means 40 (see FIG. 1) are provided for rear-end loaders, also known in the prior art, which operate in a similar manner. In either case, the openings 26 are intended to serve the dual purpose of receiving garbage for deposit and allowing exit of garbage during collection.

Figure 1:
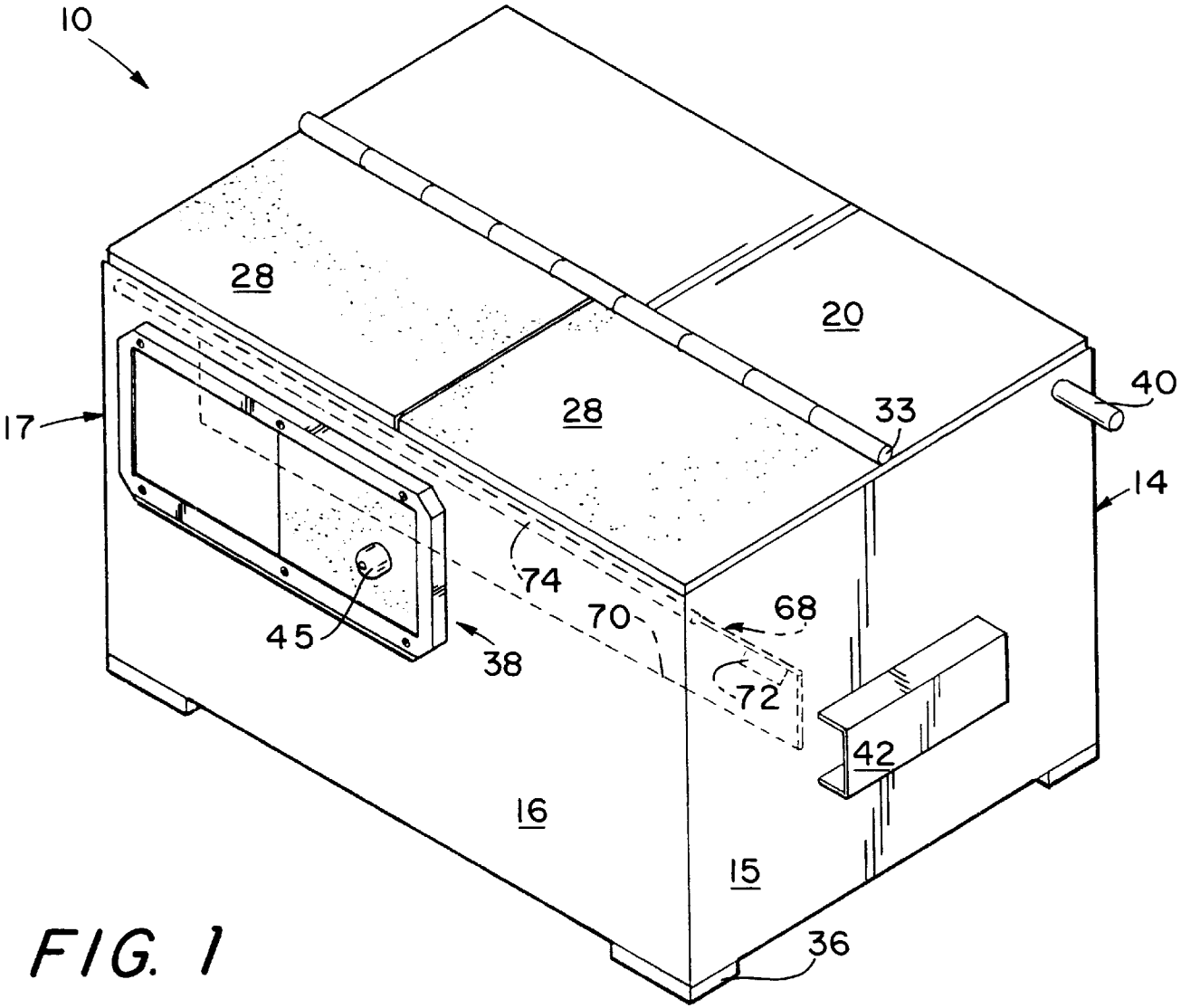
FIG. 1 is a perspective view of a first embodiment of a handicapped accessible dumpster.

Having aforedescribed the general operating features of the present invention common to most dumpsters, the dumpster 10 further provides special features and positional relationships to the described features which both allow access by disabled individuals and provide a hauler-friendly dumpster. As shown in FIG. 1, a gliding door 38 covering a second deposit opening 34 is provided in a side wall 16 of the dumpster 10 at a height at a lower edge 35 no higher than 34 inches from the point of contact between a supporting surface, e.g. the ground G. Such height limitation includes any one or more of a group support members consisting of wheels, skids 36, etc. Such height or reach limitation is based upon the height and reach restrictions as provided by the Americans With Disabilities Act, which, as with all laws, may be subject to change. As such, the 34 inch height restriction should be understood to represent the accepted norm for compliance with extant laws or regulations governing accessibility by disabled individuals as promulgated from time to time by appropriate governing bodies; therefore minor deviations or adjustments to the height as applied to the dumpster 10 should be understood as necessary and therefore not be construed as limiting the claims and spirit of this invention. The second deposit opening 34 and door 38 is at least 15 inches in height and width to accommodate a filled trash bag, and may be dimensioned larger according to the surface dimensions of the dumpster 10.

Using side wall 16 as the exemplary wall, a relationship exists between the second deposit opening 34 and the top deposit openings wherein the second deposit opening 34 is disposed below top deposit openings 28 so that a hinged baffle overhang 68 can be provided and positioned within the chamber 18 to deflect garbage deposited through the top deposit opening 26, thereby delaying the accumulation of a trash pile immediately in front of the second opening 34 (best appreciated from environmental view of FIG. 5). The baffle overhang 68 is a panel 70 downwardly inclined into the refuse chamber 18. The panel 70 is transversely positioned between the top deposit opening 26 and the second deposit opening 34. This configuration establishes an awning-like configuration, protecting the opening 34 and floor immediately below the panel 70 from accumulation due to deposit through top deposit opening 26. The panel 70 is affixed to side wall 16 by a pivoting or hinging mechanism 74, such as a collar and rod assembly, piano hinge, etc., extending from side wall 15 to side wall 17. The hinged assembly permits the panel 70 to swing upwardly towards the deposit openings 26 along the pivotal axis defined through the juncture between panel 70 and side wall 16.

Each wall 15,17 has a rest stop 72 protruding inwardly into the refuse chamber 18 to support the hinged panel 70. Each rest stop 72 is canted at about 45 degrees, and generally trapezoidal in shape, to provide ends of the stop generally horizontal at the top and generally vertical proximate the bottom. The stop member is attached to each opposing side wall with each of one of the non-parallel sides horizontally and vertically oriented in order to reduce the chance of trash catching on the stop.

Figure 2:
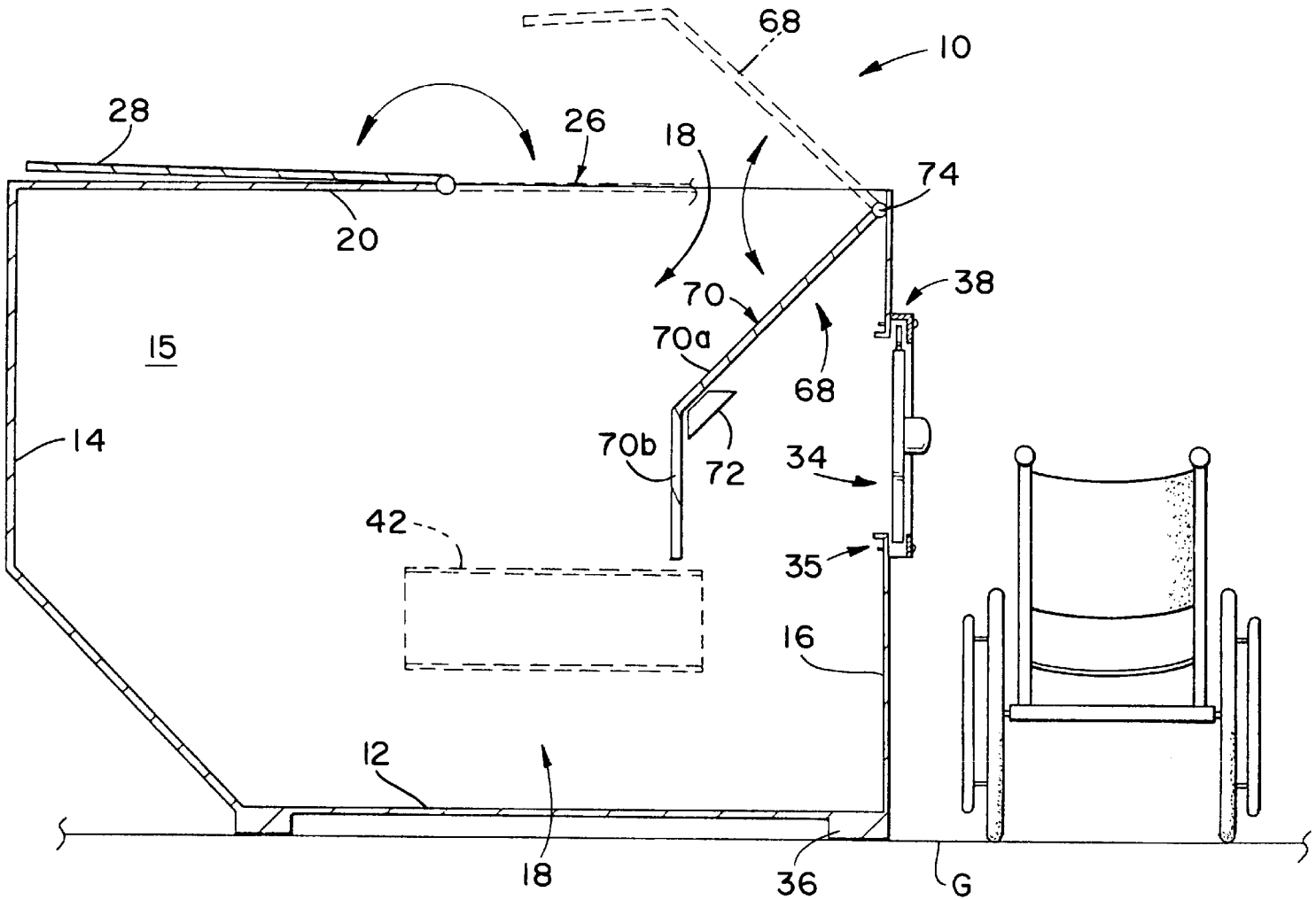
FIG. 2 is an environmental, side elevation sectional view of the handicapped accessible dumpster of FIG. 1.

The panel 70 may be configured as a generally rectangular panel of the second embodiment 110, as shown in FIG. 4 and FIG. 5, or, as an angled panel according to the preferred embodiment 10, the panel 70 being configured to permit passage through the deposit opening 26, as suggested by FIG. 2.

In the preferred embodiment 10, the angled panel has an inclined portion 70*a* and a vertical portion 70*b*. The vertical portion 70*b* minimizes accumulation of trash in front of the second deposit opening 34 due to trash being thrown into the chamber 18 with an arced trajectory through a top deposit opening opposing the second deposit opening 34. The length of vertical portion 70*b* may be varied according to the top deposit opening dimensions so that, as can be observed in FIG. 6, the panel 70 is allowed to pass through top deposit opening 26 in an arc centered on hinging means 74, yet retain a suitable baffling effect in the at-rest position shown in FIG. 2. The preferred angle of inclination of the inclined portion 70*a* is 43 degrees from horizontal, both to accommodate swinging of the panel 70 through an opening with standard dimensions of a 4 cubic yard dumpster, and, to provide ample incline to allow debris to slide due to the force of gravity into the chamber 18. However, the angle may be altered as necessary to accommodate both a suitable baffling effect and passage of the panel 70 through top deposit openings of varying sizes. Moreover, the panel 70 is hinged so that, while the dumpster is upended in an automatic overhead emptying operation by a garbage truck, the overhang falls towards the top deposit openings 26 in order to prevent garbage from being caught in what otherwise would form a V-shaped trough under the panel 70.

In the second embodiment 110 (FIGS. 4 and 5), side walls 15,17 oppose each other and support an inverted, truncated V-shaped top wall or cap 20 defining the plurality of deposit openings 26 for the deposit of trash into the chamber 18. The top wall or cap 20 supports opposing top lids 28,28 by a hinging mechanism 33. A door 21 covers second deposit opening 34. A second baffle 76 is vertically affixed on the floor 12 of the chamber 18 to further divide it in order to prevent excessive accumulation of garbage in front of second opening 34.

However, unlike the angled panel of the first embodiment, the panel 70 of the second embodiment 110 is dimensioned to be sufficiently long and wide so that, when the panel 70 is rotated towards the deposit opening 26, it occludes the deposit opening 26 from inside the chamber 18. By blocking the opening 26, although the outer top lids 28 swing open, unintended loss of trash during the emptying operation by the garbage truck is prevented through the openings 26 occluded by panel 70.

Figure 3A:
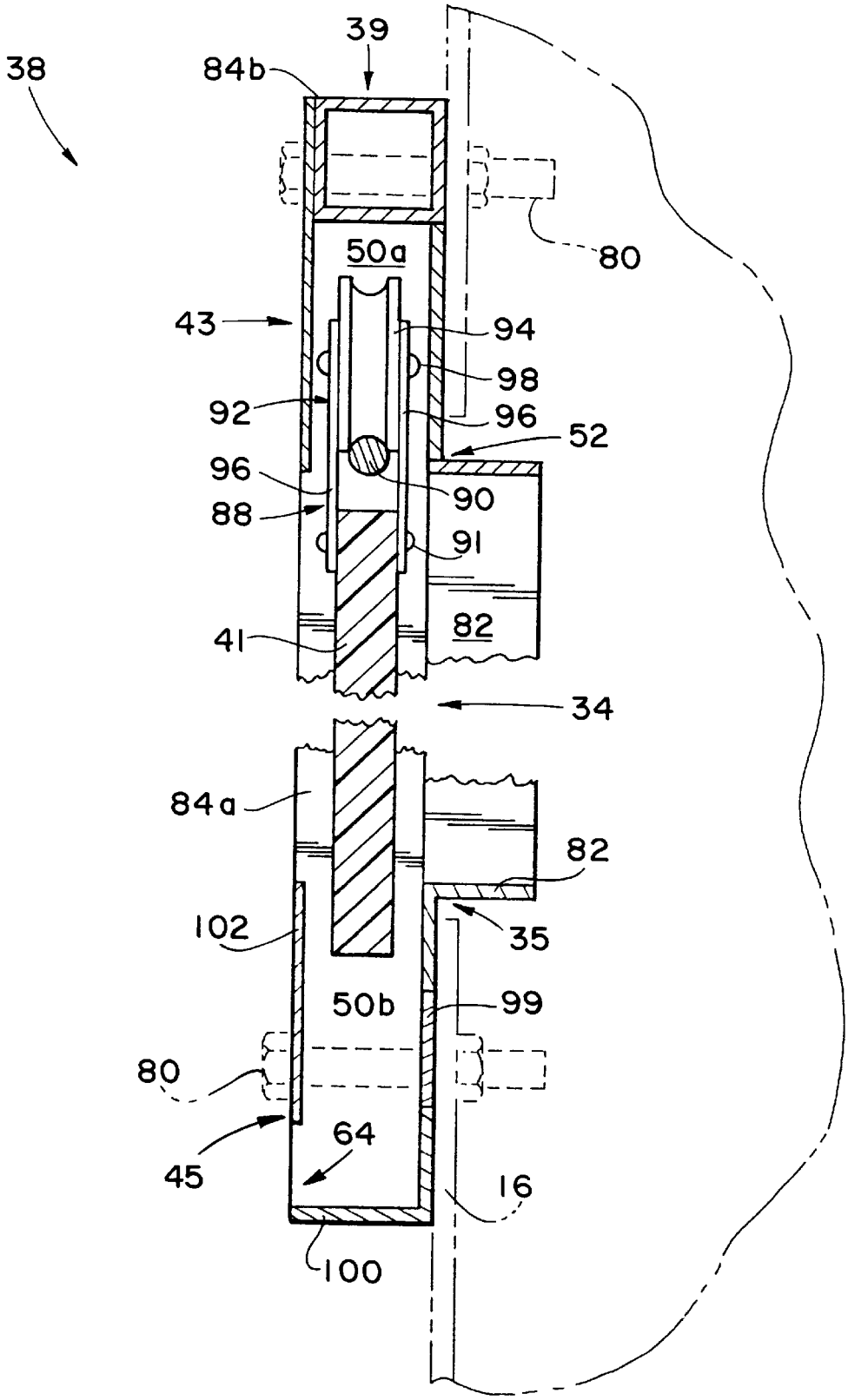
FIG. 3A is a cross-sectional view of a gliding door assembly taken along line 3A—3A of FIG. 3B.
Figure 3B:
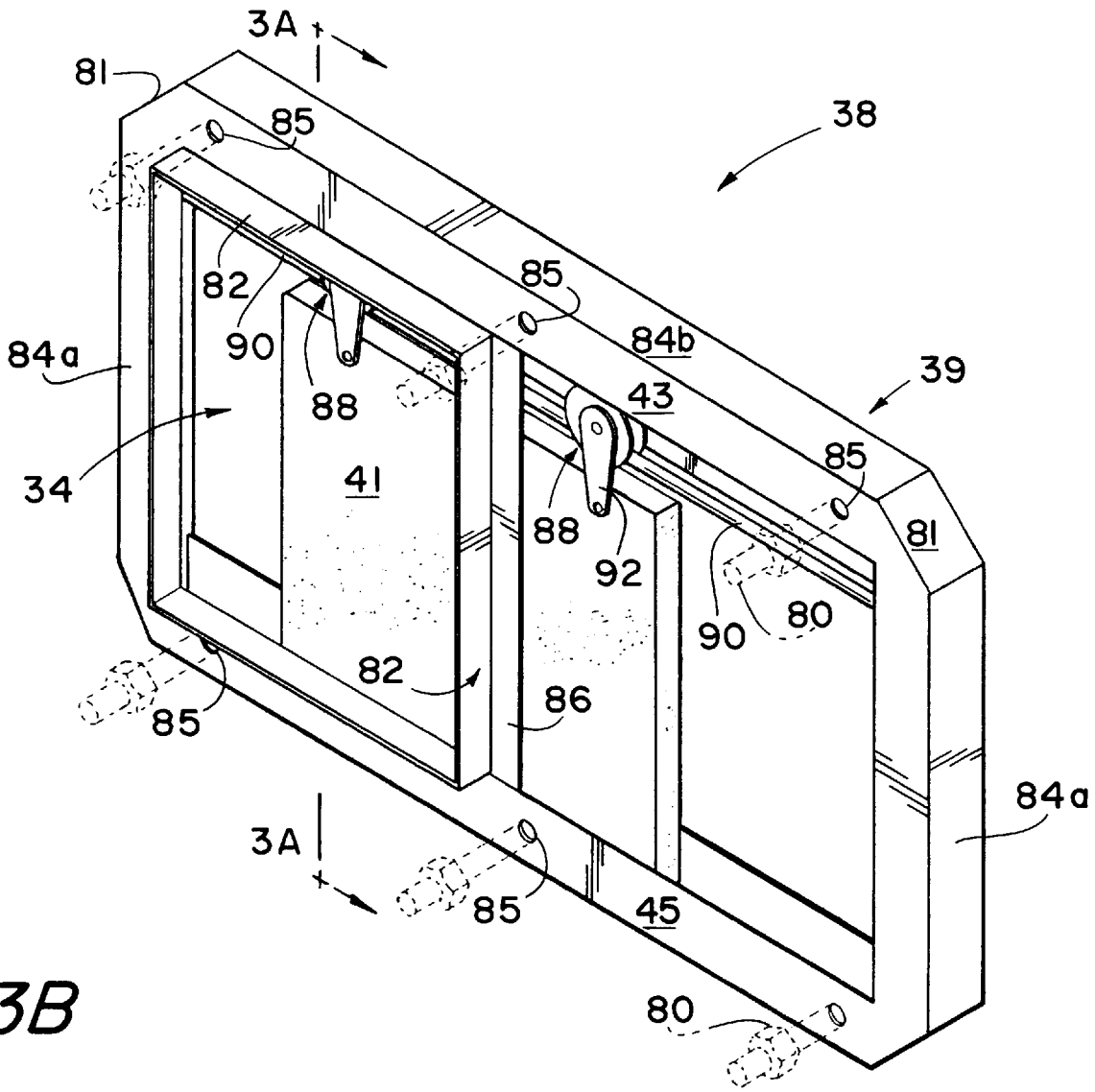
FIG. 3B is a rear perspective view of the gliding door assembly.
Figure 3C:
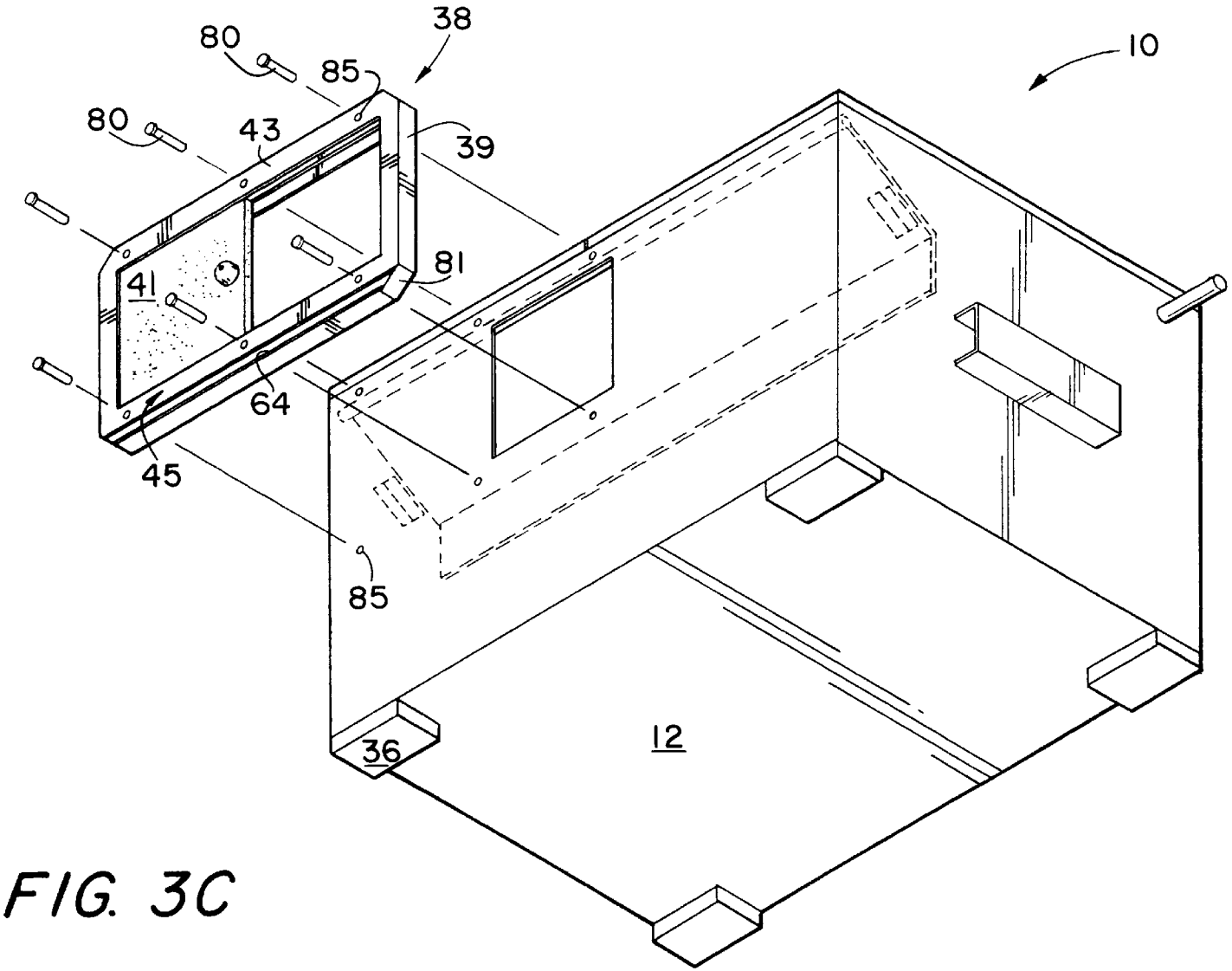
FIG. 3C is a partially exploded, perspective view of the handicapped accessible dumpster showing the gliding door assembly removed.

Turning now to the features of the gliding door 38 as shown in FIGS. 3A, 3B and 3C, the gliding door 38 comprises a unitary assembly for both retrofit attachment to existing dumpsters as well as permanent installation, particularly for new dumpsters. The gliding door 38 comprises a frame 39 supporting an overhead-hung door panel 41. The frame 39 comprises an upper track 43 and a lower track 45 which are specially configured, as further discussed below, to prevent or minimize the collection of debris and ice which could hamper the ability of a disabled individual of minimal manipulative abilities to open the gliding door. The tracks 43,45 are parallel and positioned opposing one another, and are spaced apart by tubular members 84*a*. Horizontal tubular member 84*b* forms a portion of the upper track 43, which portion is provided with apertures 85 for passage of fasteners. The lower track 45 is provided with a through-passage 64, later described, and is attached between upright tubular members 84*a*. Thus, tubular members 84*a*,84*b* integrally complete the frame 39, but also serve to stiffen the side wall of the dumpster (usually being of approximately 10 gauge sheet metal construction), after installation and modification creating second opening 34. Moreover, tubular members 84*a*,84*b* may be canted to reduce sharp corners, forming faces 81, reducing the chance of injury.

The frame 39 is affixed on the outside surface of a side wall 16 proximate to the upper edge 52 and lower edge 35 of the second deposit opening 34, the distance between edges 35,52 defining the height of second deposit opening 34, discounting tolerances for gaps, the width of materials used, etc. as nominal for sake of discussion. The frame 39 is dimensioned to be approximately twice the width of the second deposit opening 34 to accommodate side to side gliding movement of the door panel 41, such that door panel 41 occludes second deposit opening 34 in a closed position (shown in FIG. 1) and is fully removed from in front of second deposit opening 34 in an open position (shown in FIG. 3C). FIG. 3B shows the door panel 41 in a partially open position.

Also shown is a center post 86 generally bisecting the frame 39, which post 86 serves as a support for a portion of flange 82. Flange 82 depends inwardly from the frame 39 into chamber 18 of the dumpster 10, and forms a continuous band which serves as a protective rail preventing contact with all edges of the side wall 16. An angle iron may be employed for the purpose of forming a smooth, unitary post/flange for attachment to the upper track 43, lower track 45 and tubular members 84*a*,84*b* to complete the band. The frame 39 is positioned so that the continuous band closely fits within the opening formed in the dumpster side wall 16 and, particularly as a retrofit device, the frame can be secured by means of fasteners 80 passing through apertures 85 and wall 16. New dumpsters may include permanently fastened frames, such as by welds. The frame and flange 82 thus serve the purpose of a protective guard against sharp edges left by an opening, particularly when the opening is cut into sheet metal of an existing dumpster wall, for retrofit insertion of the gliding door 38.

Preferably, the door panel 41 is manufactured from an high-impact resistant plastic, such as high density polyethylene, which has lightweight characteristics as compared to the standard steel doors provided on conventional dumpsters. Such lightweight doors contribute to providing a resistive force of less than 5 pounds static pressure, allowing the gliding door 39 to very easily open, which in turn allows a disabled individual with limited strength and manipulative capabilities to more easily open the door 38 for deposit of trash. Moreover, an oversized handle 45 is further provided to facilitate opening of the gliding door 38. The handle 45 is a rounded knob of approximately two inches in diameter, which provides adequate surface area against which to press by individuals as those having amputated limb portions, or extremities frozen by crippling arthritis or rigor.

However, the principal feature contributing to low static pressure lies in a pass-through channel configuration of the lower track 45 and the over-head door gliding mechanism 88 combined with the configuration of upper track 43. FIG. 3A shows the upper track 43 and the lower track 45 between which the door panel 41 is interposed in part within a channel 50*a* of upper track 43 and channel 50*b* of lower track 35. Within channel 50*a*, a rail 90 is transversely positioned to side wall 16, between upright tubular members 84*a*, and parallel to the upper and lower tracks 43,45. A wheel assembly 92 rides on rail 90, the assembly preferably comprising a nylon wheel 94 and an axle 98 to which forks 96 are attached, the forks 96 passing downward of either side of rail 90 to attach to door panel 41 by fasteners 91, thereby generally characterizing an overhead-hung gliding door. The wheel assembly 92 stays positioned vertically within channel 50*a* by virtue of the door panel 41 freely hanging and acting as a counterweight, while being restrained from lateral movement by lower track 45.

As can be further observed, by virtue of this configuration, the wheel assembly 92 is substantially protected from direct access by falling particulate debris from both within chamber 18 and exterior to side wall 16. Upper track 43 forms a barrier against precipitation, gravel, trash and other debris from lodging within channel 50*a*. Likewise, the side wall 16 ending along edge 52 in combination with flange 82 prevents debris from entering channel 50*a* from within the chamber 18. Please note that although the rail 90 is shown in FIGS. 3A and 3B in a low, exposed position for clarity of illustration and discussion, the rod is preferably positioned within upper track 43 more proximate to horizontal tubular member 84*b*, thereby being further recessed within channel 50*a*, and thus providing a more complete closure of door panel 41 in front of second deposit opening 34 and reducing further the possibility of debris lodging in channel 50*a*.

Turning now to the features of lower track 45, to prevent the accumulation of debris, water, ice, snow and the like, a through-passage 64 is provided in the bottom of lower track 45, forming a partially open front. Alternatively, a through-passage allowing direct downward passage may be provided. However, for ease of construction, a front passage 64 is preferable in so far as three independent members may be used, namely an angle iron forming flange 82, a flat bar 99 forming the rear wall of lower track 45 and a second angle iron 100, each being fused to one another to form a unitary piece. Front bar 102 completes the lower track 45, being attached to each upright tubular member 84*a* and preventing door panel 41 from swinging laterally forward.

It is to be understood that the present invention is not limited to the sole embodiment described above, but encompasses any and all embodiments within the scope of the following claims.

I claim:

1. A handicapped accessible dumpster, comprising:

a refuse bin having a floor, a plurality of side walls forming an enclosed perimeter, said walls including a first side wall and opposing side walls adjacent said first side wall, and a top wall, together defining a chamber within for collection of refuse, said top wall defining a first deposit opening, and said first side wall defining a second deposit opening having a lower edge positioned in said first side wall at a height not greater than 34 inches from a surface supporting said dumpster;

a baffle overhang including a first baffle panel attached to said first side wall and positioned transversely thereto between said opposing side walls, said first baffle panel positioned below said first deposit opening and above said second deposit opening, said first baffle panel inclined downward from said first side wall toward said floor of said chamber;

hinging means for rotating said first baffle panel relative to said first side wall; and a stop member attached to each said opposing side walls for supporting said first baffle panel.

2. The dumpster according to claim 1, wherein said stop member is trapezoidal in shape with the non-parallel sides of the trapezoidal shaped stop member respectively being horizontally and vertically oriented.

3. The dumpster according to claim 1, wherein said first baffle panel has a transverse bend forming two faces angled relative to one another.

4. The dumpster according to claim 1, further comprising a second baffle panel vertically attached to said floor and generally parallel to said first side wall.

5. A handicapped accessible dumpster comprising:

a refuse bin having a floor, a plurality of side walls forming an enclosed perimeter, said walls including a first side wall and opposing side walls adjacent said first side wall, and a top wall, together defining a chamber within for collection of refuse, said top wall defining a first deposit opening, and said first side wall defining a second deposit opening having a lower edge positioned in said first side wall at a height not greater than 34 inches from a surface supporting said dumpster; and a gliding door for covering said second deposit opening, wherein said gliding door comprises:

a frame surrounding said second deposit opening, said frame having an upper track and a lower track, said upper track defining a upper channel opening downward, said lower track comprising a front bar and a rear bar attached parallel to one another and spaced apart to define a lower channel opening upward, said channel in downward communication with a through-passage defined in said lower track;

a rail for suspending a gliding means substantially disposed within said upper channel;

a gliding means suspended from said rail; and, a door panel sized to cover said second deposit opening, having an upper edge and a lower edge, said upper edge suspended from said gliding means and said lower edge disposed in said lower track;

whereby said door panel is freely suspended from said upper track by said gliding means, said upper track substantially enclosing said gliding means from above to prevent lodging of falling debris into said upper channel, and said lower track preventing lateral movement while permitting falling debris to pass through said through-passage by force of gravity.

6. The dumpster according to claim 5, wherein said frame includes a flange depending inward and perpendicularly from said upper track, said lower track and said upright members to define a continuous band closely fitting within said second deposit opening.

7. The dumpster according to claim 5, further comprising means for removably attaching said frame to said first side wall.

8. The dumpster according to claim 5, wherein said gliding door is provided with an oversized handle.

9. The dumpster according to claim 8, wherein said gliding door is provided with an oversized handle dimensioned and configured as a knob no less than two inches in diameter and having a rounded surface.

10. The dumpster according to claim 1, further including means for receiving complementary lifting means of an automated motor vehicle for collecting refuse.

* * * * *